United States Patent [19]

Grant

[11] Patent Number: 4,506,825

[45] Date of Patent: Mar. 26, 1985

[54] SOLENOID OPERATED DAMPER BLADES

[76] Inventor: Willie T. Grant, 400 S. Simms St., Lakewood, Colo. 80228

[21] Appl. No.: 461,277

[22] Filed: Jan. 26, 1983

[51] Int. Cl.[3] ..... F24F 13/14

[52] U.S. Cl. ..... 236/9 A; 74/109; 137/601; 236/49; 236/84

[58] Field of Search ..... 236/49, 9 A, 84; 98/107, 110, 121 A; 137/601; 74/109, 89.17, 422

[56] References Cited

U.S. PATENT DOCUMENTS

| | | | |
|---|---|---|---|
| 83,286 | 10/1868 | Johnston | 98/107 X |
| 1,440,655 | 1/1923 | Bliss | 236/84 |
| 1,460,785 | 7/1923 | Buckley | 74/422 |
| 1,518,894 | 12/1924 | Buss | 236/84 |
| 2,269,036 | 1/1942 | Nessell | 236/9 A X |
| 2,570,624 | 10/1951 | Wyckoff | 236/84 X |
| 2,693,825 | 11/1954 | Carr | 137/601 X |
| 3,847,210 | 11/1974 | Wells | 137/601 X |

*Primary Examiner*—William E. Tapolcai

[57] ABSTRACT

Solenoid motor means for operating a multiple blade damper device; said blades being pivotally mounted in a common housing; said housing being constructed to reside in an open ended duct boot that is part of the duct network for the distribution of the heating/cooling medium of a central heating/cooling device. Each of the multiple damper blades is attached to a rotatable means such as a timing pulley or gear; said rotatable means are rotated by a rack having engaging means such as gear teeth; said engaging means are interconnected through a carriage to a plunger common to dual solenoids; said carriage translates linearly with said plunger to provide aforesaid rotation to rotatable means to open or close damper blades in accordance with commands of a temperature control means.

14 Claims, 7 Drawing Figures

SOLENOID OPERATED DAMPER BLADES

Patent application Ser. No. 312,339 sets forth solenoid motor means for automatic operation of a single damper blade pivotally mounted within a damper housing, said damper housing being constructed to be installed within the open end of a duct boot. The damper blade provides means to regulate the quantity of air entering a room or zone being served by a central heating/cooling device. In many modern homes having a central heating/cooling device, the standard air registers require multiple damper blades. The cable means described in Ser. No. 312,339 do not easily accommodate the simultaneous operation of multiple damper blades in a common damper housing.

The present invention provides a solenoid motor means that overcome the difficulties inherent in the earlier invention relative to the operation of a multiblade damper device. The present solenoid motor means operating multiple damper blades located in a common housing include two linear solenoids positionally placed within said damper housing to accommodate a common plunger translating alternately between the two solenoids when either of said solenoids is energized by means of a circuit electrically connecting the solenoids to said heating/cooling device via temperature control means. The aforementioned plunger is encompassed by a circular sleeve; said sleeve being part of a carriage supporting a rack having engaging means, a retainer, an adjustable stop; said carriage provides for attachment between said rack and said sleeve. The assemblage, consisting of said solenoids, plunger, carriage, and rack having engaging means is located at one extremity of the damper housing. Rotatable means attached to the damper blade bearing pins, have other engaging means that mesh with engaging means of aforesaid rack. The rotatable means are concurrently pivoted by said rack whenever the plunger is linearly translated by either solenoid; said solenoid responding to a command from aforesaid temperature control means. The rotation of rotatable means occurs whenever solenoid motor means and rack having engaging means cooperate to rotate damper blades to an open or closed position in accordance with aforesaid command of temperature control means. Switch means, electrically located between said temperature control means and solenoid means, are operated by a switch operator; said switch operator being inserted on a bearing pin of a single damper blade. The exterior of the solenoid motor means is covered with a sound dampening material that reduces or alleviates the noise caused by to metal-to-metal contact when solenoids are in operation; said metal-to-metal contact is likewise restrained by the aforesaid adjustable stop; said stop, secured within a retaining cylinder, has resilient cushioning on each extremity.

A first alternate means for rotating the multiple damper blades include dual solenoids having a common plunger translating alternately between said solenoids, a movable carriage incorporating a cylindrical sleeve encompassing the plunger. The sleeve is fixedly attached to the plunger and translates with said plunger; said carriage also has a rack with engaging means that mesh with other engaging means of a single rotatable means. The rotatable means are attached to a bearing pin on one of the multiple damper blades. Each of the multiple blades has a connector plate attached to one face; and all said plates are interconnected by a linkage bar; said bar transmits rotation from the single blade having said rotatable means to all other damper blades when said blade having rotatable means is rotated by rack having engaging means; said rack moves with plunger when said plunger is translated by either solenoid of solenoid motor means as previously described in the operation of device 10.

A second alternate for rotating the multiplicity of damper blades in a common housing is comprised of dual solenoids having a common plunger translating alternately between said solenoids. The plunger is secured within a cylindrical sleeve, and said sleeve has an integral lug attached to the top thereof; said lug, by means of a connecting rod, is operatively connected to a cam, said cam is fixedly attached to a bearing pin of one of the multiple damper blades; and the cam rotates said damper blade in response to the temperature control means located in a space or zone to be heated or cooled. In addition to providing rotation to said damper blade, the cam automatically operates switch means; said switch means open and close the electrical circuits controlling said dual solenoids.

Each of the multiple damper blades has a connector plate attached; all said plates are interconnected by a conneting bar that transmits rotation of damper blade having cam to all other damper blades. Noise suppression means are inserted on the plunger to prevent said plunger from reaching a complete seating position within solenoid housing, thereby reducing the noise level normally associated with the operation of a linear solenoid.

It is, therefore, a primary object of the present invention to provide solenoid motor means to operate a multiple blade damper.

Another object is to provide a sound dampening means for solenoids when said solenoids undergo an operational cycle.

Another object is to provide solenoid motor means responsive to a temperature control means to operate a multiple blade damper.

Another object is to provide engaging means translated by solenoid motor means to convert rectilinear motion into rotational motion thereby rotating a multiplicity of damper blades in a common damper housing.

Referring to the accompanying drawings.

Figure 1:
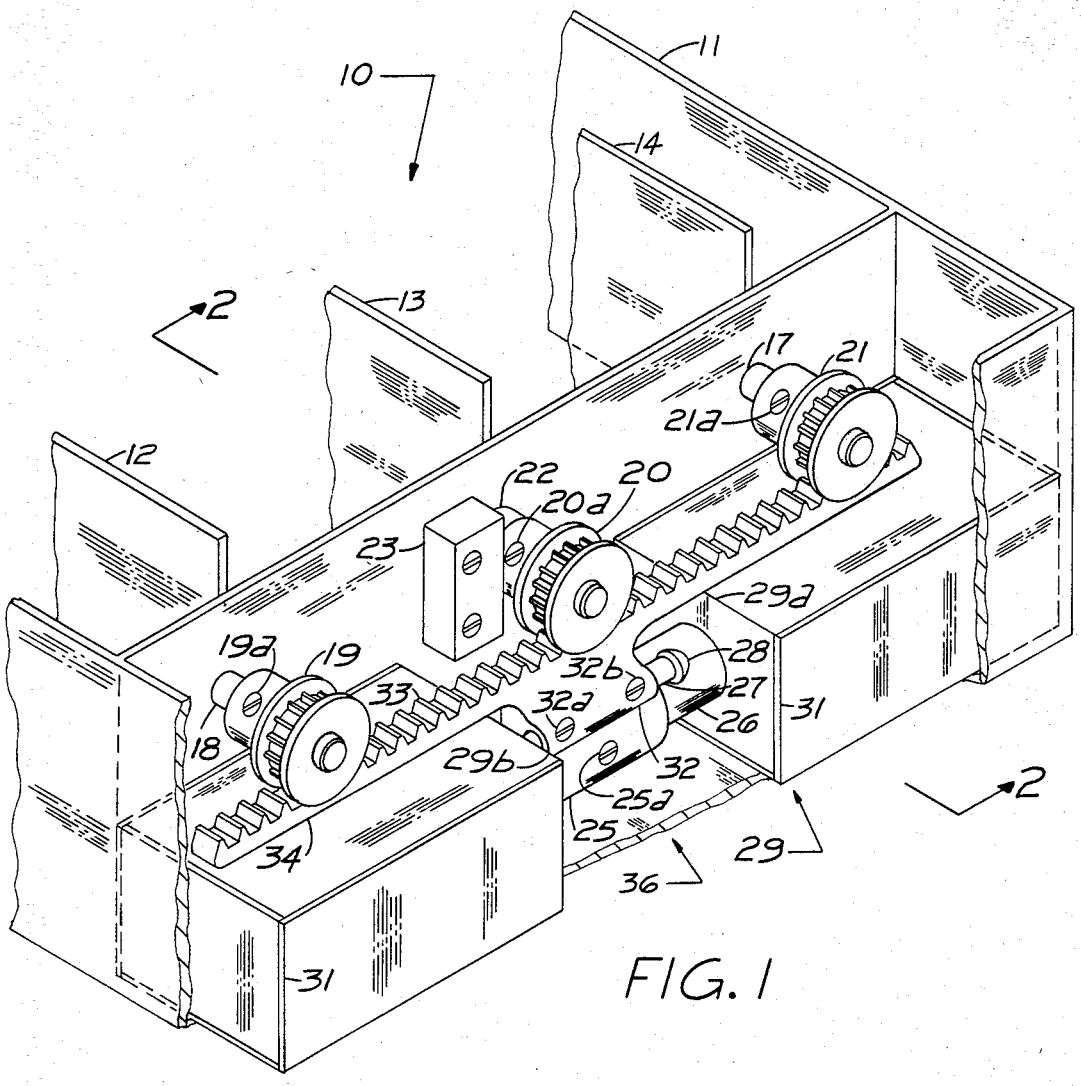
FIG. 1 is an isometric view of an automatic damper device constructed according to the present invention.

Making reference to the drawings more particularly by identification numbers, number 10 in FIG. 1 shows an automatic damper device constructed according to the present invention. Device 10 includes a damper housing 11, a multiplicity of damper blades 12, 13, and 14, solenoid motor means 29 incorporating solenoids 29*a* and 29*b*, movable carriage 36, rotatable means 19, 20, and 21, switch means 23, and sound dampening means 31.

Figure 4:
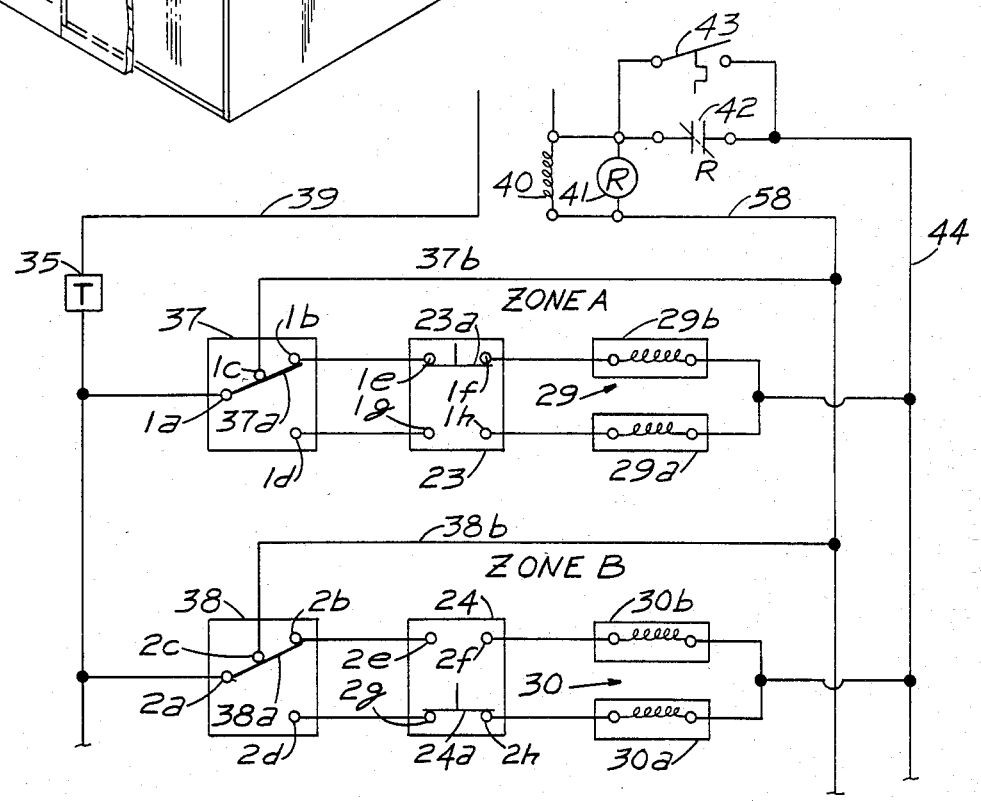
FIG. 4 is a schematic circuit diagram of the automatic damper device.

In describing the operation of device 10, attention is given initially to FIG. 4 and the circuit for Zone A; said circuit consists of timer switch 35 (said timer switch being similar to the timing switches or devices used in clock radios, automatic lawn sprinkling systems, automatic ovens, etc. to turn a system on or off after a measured time period has lapsed) that opens and closes the primary circuit (common to all zones), according to preset time intervals, a mercury or snap action four-wire temperature control means 37 connecting to solenoids 29*a* and 29*b*, through intermediate switch means 23 (two circuit switch), to gas valve solenoid 40 of a heating/cooling device and to relay 41. When the environment in Zone A signals temperature control means 37 to influence a temperature adjustment in said Zone A, A temperature control means switch 37*a* closes contacts 1*a*–1*b* and 1*a*–1*c* to energize gas valve solenoid 40 and relay 41 via conductor 37*b*. Solenoid 29*b* (FIGS. 1 and 4) is simultaneously energized through switch 37*a* of temperature control means 37, switch 23*a* of switch means 23, conductor 44, and contacts 42 (said contacts having instantaneously closed when relay 41 energized).

Figure 2:
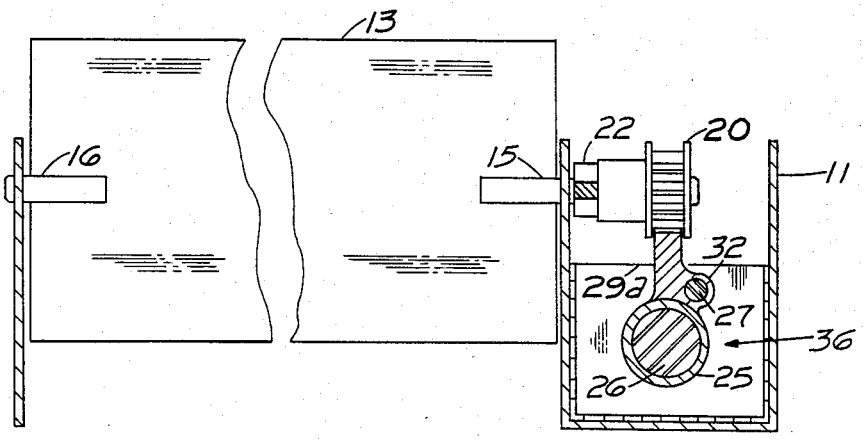
FIG. 2 is a cross-sectional view along line 2—2 of FIGS. 1 and 3.

Energizing solenoid 29*b* of solenoid motor means 29 retracts plunger 26 (FIG. 1) into the internal coil of said solenoid 29*b* influencing carriage 36 to translate linearly in the same direction as said plunger, pivoting rotatable means 19, 20, and 21 attached respectively to damper blades 12, 13, and 14, and subsequently opening said damper blades. Carriage 36 (FIG. 2) is comprised of cylindrical sleeve 25 receiving plunger 26 and having said sleeve secured to said plunger by means of fastener 25*a* (FIG. 1), adjustable stop 27 arresting movement of said plunger 26, resilient cushioning 28 preventing impact of plunger 26 against internal seat of solenoids 29*a* and 29*b*, retainer 32 securing adjustable stop 27 through fastening means 32*a* and 32*b*. Rack 34, having engaging means 33, is connected to sleeve 25 of carriage 36, said rack having engaging means 33 on the terminal surface to mesh with other engaging means on the circumference of rotatable means 19, 20, and 21. Engaging means 33 on rack 24 mesh with other engaging means on said rotatable means 19, 20, and 21 to convert the linear motion experienced by rack 34, as plunger 26 is being drawn into solenoid 29*a* or 29*b*, into rotary motion of said rotatable means; said linear motion transmitted through sleeve 25 and carriage 36 to said rack 34 and converted into rotary motion at the interface of engaging means 33 of rack 24 and other engaging means of rotatable means 19, 20 and 21 influences said rotatable means to open or close said damper blades 12, 13, and 14.

Switch operator 22 is attached to bearing pin 15 of damper blade 13 and rotates with said bearing pin to open and close switch means 23 (FIGS. 1 and 4); said switch means functioning to provide an open or closed circuit between temperature control means 37 and solenoid means 29.

When temperature control means 37 (FIG. 4) of Zone A have been satisfied, switch 37*a* closes contacts 1*a*–1*d* providing a closed circuit through solenoid 29*a*, switch 23*a* (said switch being previously moved to position 1*g*–1*h* by switch operator 22), and contacts 42. As shown in FIG. 4, Zone B, temperature control means 38 are concurrently calling for an adjustment to the environment for Zone B and consequently provide a closed circuit through conductor 38*b* to energize a damper closing controller consisting of relay 41 and contacts 42. When relay 41 is energized, contacts 42 close, thereby closing aforesaid circuit through solenoid 29*a* of Zone A and influencing the subsequent closure of damper blades 12, 13, and 14 in device 10 in Zone A. As temperature control means 38 of Zone B are satisfied, internal switch 38*a* moves to position 2*a*–2*d* opening the circuit incorporating conductor 38*b* and instantaneously de-energizing relay 41 and opening associated contacts 42, creating an open circuit through temperature control means, switch 38*a* (currently in position 2*a*–2*d*), switch 24*a*, solenoid 30*a*, and open contacts 42. This open circuit keeps the damper blades of device 10 of Zone B in their open positions, permitting all residual conditioned air to be blown from the heating chamber of the heating/cooling device into Zone B which is the last of the zones presently calling for conditioned air. When a temperature control means for another zone later requests conditioned air, relay 41 will be energized as previously explained, closing contacts 42 and completing aforementioned circuit in Zone B; said damper blades in device 10 of Zone B will rotate to the closed position through action of solenoid 30*a*.

Optional means for closing the damper blades of device 10 of the last zone to receive conditioned air are shown as a hi-temperature thermostatic switch 43 (FIG. 4); said switch being normally closed is placed in the flue duct or similar location of the aforesaid heating-/cooling device and said switch opens with rising temperature (during a heating cycle) to prevent a current flow through the circuit involving solenoid 30*a* of Zone B when Zone B is the last zone having elecrical control over heating/cooling device. When temperature control means 38 of Zone B have been satisfied and gas valve solenoid 40 and relay 41 are de-energized, opening contacts 42, damper blades 12, 13, and 14 of device 10 in Zone B remain in an open position until thermostatic switch 43 cools to a preset closing temperature at which time the aforesaid circuit involving solenoid 30*a* is completed through currently closed hi-temperature thermostatic switch 43, and solenoid 30*a* rotates said damper blades to the closed position as previously described. It is obvious that any number of zones can be included in parallel with the electrical system shown in FIG. 4, and the resulting operation of their dampers will be identical to that heretofore explained.

Figure 3:
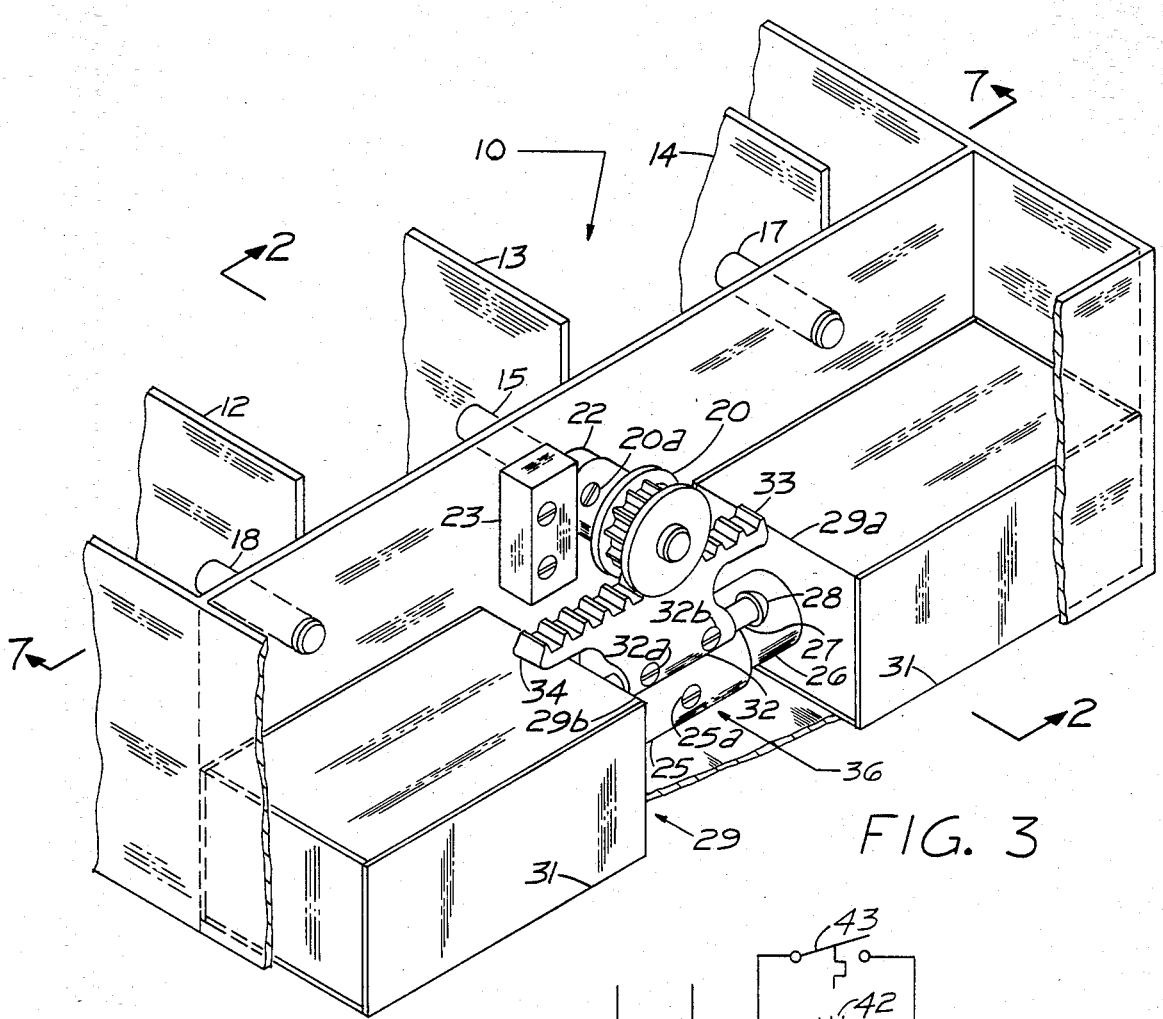
FIG. 3 is an isometric view of the automatic damper device showing a first alternate rotatable damper means.

FIG. 3 shows a first alternate means wherein rotatable means consist of a single rotatable means 20 attached to damper blade 13. Rack 34 having engaging means 33 is sufficiently shortened to operate said rotatable means 20; said said rotatable means having other engaging means on the periphery; said shortened rack 34 operates said rotatable means 20 as previously described for multiple rotatable means; said operation of rotatable means 20 rotates said damper blades between an open and closed position. Damper blades 12 and 14 are operatively connected to blade 13 by linkage means 49 (FIG. 7); said linkage means consisting of connecting bar 48 and connector plates 45, 46, and 47. The aforementioned connector plates are rigidly attached to damper blades 12, 13, and 14 respectively; and said connector plates are interconnected by connecting bar 48. Connecting bar 48 transmits rotation from damper blade 13 to damper blades 12 and 14, and is pivotally attached to connector plates 45, 46 and 47 by fastening means 45*a*, 46*a* and 47*a*. When damper blade 13 rotates under the influence of rotatable means 20, plate 46 forces connecting bar 48 to move linearly and parallel to the movement of plunger 26; said movement of connecting bar 48 simultaneously rotates damper blades 12 and 14 in accordance with the requirements of the temperature control means 37 of Zone A.

Figure 5:
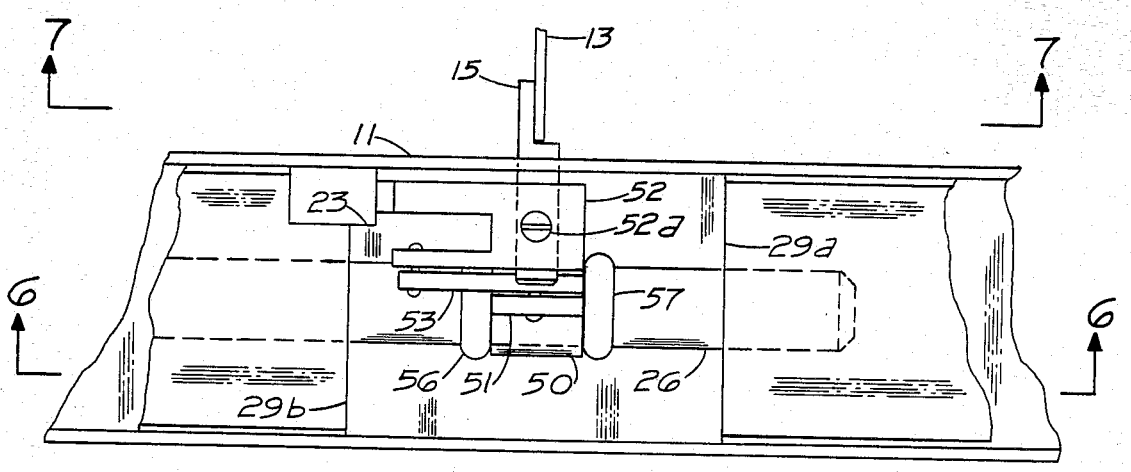
FIG. 5 is a plan view of the automatic damper device showing a second alternate rotatable damper means.
Figure 6:
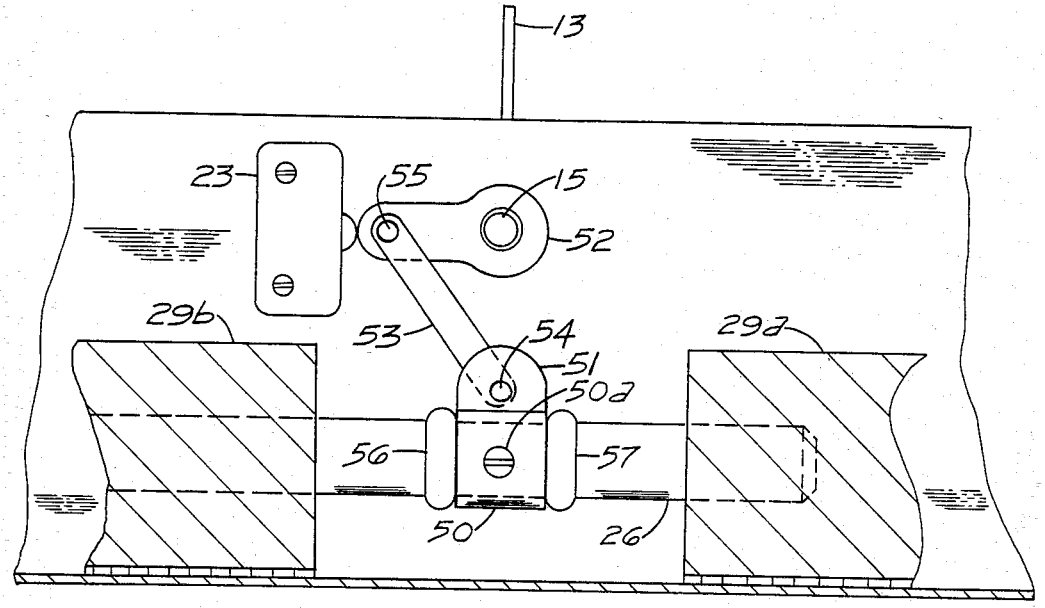
FIG. 6 is a view taken along line 6—6 of FIG. 5.
Figure 7:
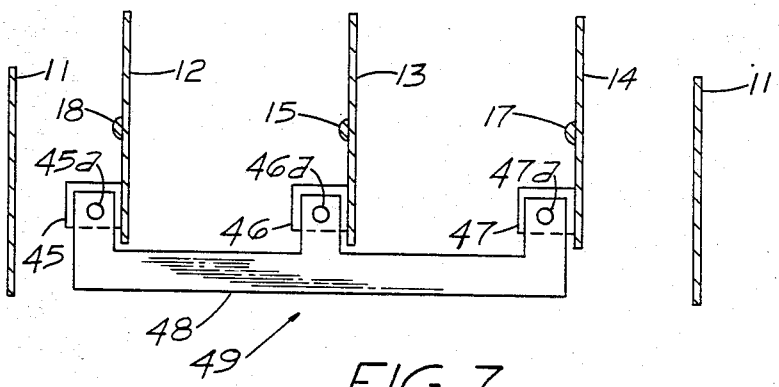
FIG. 7 is a cross-sectional view along line 7—7 of FIGS. 3 and 5.

FIGS. 5, 6, and 7 show a second alternate means for the rotatable means; said second alternate means are comprised of cyclindrical sleeve 50 having an integral lug 51 attached thereto, and plunger 26 inserted through the sleeve opening. Sleeve 50 with attached lug is secured to said plunger 26 by means of fastener 50*a*. Cam 52 is inserted on and attached to bearing pin 15 of damper 13, and is operatively connected to lug 51 by means of connecting rod 53; said rod being capable of pivoting about pins 54 and 55 on each end of said rod 53. When plunger 26, operating as previously described in the operation of device 10, translates sleeve 50 and lug 51 to the right in FIGS. 5 and 6, pin 54 moves the corresponding end of rod 53 linearly, coercing the opposite end of said rod 53 to rotate along a circular arc and rotate cam 52 by means of pin 55; said rotation is transmitted to damper 13 through the connection of cam 52 to bearing pin 15 by means of fastener 52*a* (FIG. 5); said cam 52 performs the dual function of capturing connecting rod 53 and operating switch means 23; said switch means being utilized to open and close circuits for solenoid motor means 29. When Zone A (FIG. 4) requires an adjustment to the environment, and temperature control means 37 have been satisfied, solenoid 29*a* is energized to move plunger 26 to the right in FIG. 6, translating and rotating connecting rod 53 and cam 52. Damper blades 12, 13, and 14 of device 10 are placed in a closed position as connecting bar 48 transmits rotation of damper plate 13 to damper plates 12 and 14 in accordance with the earlier description.

Resilient stops 56 and 57 are located on plunger 26 between each end of sleeve 50 and each face of solenoid 29*a* and 29*b*; limiting travel of said plunger into solenoid coil, assisting in placing damper blades in the preferred open or closed positions, and aiding in alleviating noise associated with seating of the plunger in the solenoid housing.

Thus there has been shown and described novel automatic solenoid motor means which fulfill all of the objects and advantages sought after. To those skilled in the art, many changes, modifications, variations, and other uses will become apparent after considering this specification and accompanying drawings. All such changes, modifications, variations, and other uses and applications which do not deviate from the spirit and scope of the invention are deemed to be covered by the invention which is limited only by the following claims:

I claim:

1. Automatic damper means controlling the flow of a conditioned medium from a heating/cooling device to rooms or zones, said damper means comprising a damper device having a multiplicity of pivotally mounted damper blades; rotatable means rotating said damper blades within an adjustable housing of said damper device, solenoid motor means energized by electrical means; switch means energizing and de-energizing circuits of said electrical means; carriage means providing mechanical connection between said solenoid motor means and said rotatable means; engaging means; said engaging means having connection to said carriage means and providing interaction between said rotatable means and said carriage means; sound dampening means surrounding said solenoid motor means, adjustable stops, a timer switch, and a damper closing controller; said solenoid motor means comprising dual linear solenoids; said solenoids having a common plunger moving alternately between said solenoids when said solenoid motor means are energized by said electrical means; said plunger transmitting linear motion to said carriage means; said carriage means attaching to said plunger and to said engaging means; said engaging means having mechanical interaction with said rotatable means; said interaction converting rectilinear motion of said carriage means into rotational motion of said rotatable means and said multiplicity of damper blades; said damper closing controller comprising a relay, electrical contacts, and a high temperature thermostatic switch; said contacts being opened and closed by said relay; said thermostatic switch being insertable in a flue or like location in said heating/cooling or like device and operating said solenoid motor means of said damper means; said electrical means having thermostatic means controlling said motor means and fuel control means of said heating/cooling device in combination.

2. The means defined in claim 1 wherein said rotatable means are comprised of multiple timing pulleys, gears, or like means having corrugations or teeth on a circumference of said pulleys, gears, or like means; said rotatable means being attachable to each of said multiplicity of damper blades.

3. The means defined in claim 1 wherein said solenoid motor means consist of two linearly acting solenoids; said solenoids translating said common plunger alternately between said solenoids when one of said solenoids is responding to electrical means; said electrical means energizing said solenoids.

4. The means defined in claim 1 wherein said electrical means energize and control said solenoid motor means through temperature control means and said switch means; said switch means being operated by a switch operator attached to one of said multiple damper blades.

5. The means defined in claim 1 wherein said engaging engagable means comprise the terminal surface of said carriage means; said surface having corrugations, teeth, or like devices meshing with corrugations, teeth, or like devices on circumference of said rotatable means converting rectilinear motion of solenoid motor means to a rotary motion of said damper blades.

6. The rotatable means defined in claim 1 being comprised of a single timing pulley, gear, or like means having other engaging means on circumference of said timing pulley, gear, or like means; said other engaging means being corrugations, teeth, or like devices meshing with engaging means on said carriage; said rotatable means including linkage means.

7. The means defined in claim 6 wherein said linkage means consist of connector plates attached to said multiple damper blades and a connecting bar pivotally connecting said damper blades one to another.

8. The timer switch defined in claim 1 electrically and cyclically interlocking said electrical means of said solenoid motor means to said heating/cooling or like device being automatically and electrically connected to and disconnected from said solenoid motor means in accordance with preset timing intervals on said timer switch.

9. The means defined in claim 1 wherein said carriage means attaching to said plunger of the solenoid motor means and movable with said plunger; said carriage means having a surface terminating in said engaging means; said engaging means interacting mechanically with other engaging means on circumference of said rotatable means converting rectilinear motion of said carriage means into rotational motion of said rotatable means, and pivoting the multiplicity of damper blades between open and closed positions; said carriage means having a retainer, said retainer holding and securing said adjustable stops with cushioning means.

10. The means defined in claim 9 wherein the adjustable stops are comprised of movable means having resilient cushioning on exposed extremities of said movable means; said cushioning aiding in noise reduction and damper positioning during operation of solenoid motor means.

11. The means defined in claim 1 wherein said damper closing controller comprising a relay, electrical contacts, and said high temperature thermostatic switch, interlocks with the electrical means of each zone; said damper closing controller being electrically operated by said thermostatic means.

12. The means defined in claim 1 wherein said rotatable means providing rotation for opening and closing said multiple blades pivotally mounted in said damper housing; said rotatable means having interaction with said carriage means through said engaging means; said carriage means comprising a sleeve having a lug attaching thereto; said engaging means being a connecting rod linking said rotatable means and said carriage means; said rotatable means comprising a cam and linkage means; said sleeve of said carriage means encompassing said plunger of said solenoid motor means and attaching to said plunger; said lug pivotally supporting one extremity of said engaging means; other extremity of said engaging means attaching to said cam of said rotatable means; said cam connecting to one of the multiple damper blades and transmitting rotation to said damper blade when said plunger is translated by said solenoid motor means; said damper blade, having said cam attached, transmitting rotation to the multiplicity of blades through said linkage means of said rotatable means.

13. The means defined in claim 12 wherein said linkage means comprising connector plates attaching to said multiple damper blades and a common connecting bar pivotally attached to each said connector plate, thereby interlocking all said connector plates to commonly receive rotation from said damper blade driven by said rotatable means.

14. The automatic damper means defined in claim 1 wherein said carriage means, having said engaging means, interconnecting said solenoid motor means and said rotatable means; said rotatable means, having other engaging means, attaching to a driven blade of said multiplicity of blades; said blades being interconnected by linkage means to be rotated between opened and closed positions when said solenoid motor means responds to said thermostatic means.

* * * * *